US009431695B2

(12) United States Patent
Miyajima

(10) Patent No.: US 9,431,695 B2
(45) Date of Patent: Aug. 30, 2016

(54) VEHICLE-MOUNTED REPLACEMENT ANTENNA

(71) Applicant: Beat-Sonic Co., Ltd., Nisshin-shi, Aichi (JP)

(72) Inventor: Eiji Miyajima, Nisshin (JP)

(73) Assignee: BEAT-SONIC CO., LTD., Nisshin-shi, Aichi (JP)

( * ) Notice: Subject to any disclaimer, the term of this patent is extended or adjusted under 35 U.S.C. 154(b) by 305 days.

(21) Appl. No.: 14/317,616

(22) Filed: Jun. 27, 2014

(65) Prior Publication Data

US 2015/0015444 A1 Jan. 15, 2015

(30) Foreign Application Priority Data

Jul. 9, 2013 (JP) ..... 2013-143163

(51) Int. Cl.
*H01Q 1/32* (2006.01)
*H01Q 1/42* (2006.01)
*H01Q 3/02* (2006.01)

(52) U.S. Cl.
CPC ..... *H01Q 1/3275* (2013.01)

(58) Field of Classification Search
CPC ..... H01Q 1/3275
USPC ..... 343/713, 872
See application file for complete search history.

(56) References Cited

U.S. PATENT DOCUMENTS 9,153,864 B2 * 10/2015 Iwata ..... H01Q 1/085

FOREIGN PATENT DOCUMENTS

JP 2011-228767 A 11/2011
JP 2012-169892 A 9/2012

* cited by examiner

*Primary Examiner* — Dameon E Levi
*Assistant Examiner* — Ricardo Magallanes
(74) *Attorney, Agent, or Firm* — Muncy, Geissler, Olds & Lowe, P.C.

(57) ABSTRACT

A vehicle-mounted replacement antenna includes an antenna holder, an antenna element, a connecting shaft and a concealed screw. The concealed screw is embedded into a concealed screw hole of a cylindrical portion of the antenna holder, and a distal end of the concealed screw is pressed against a bottom surface of a ring groove of a hook shaft portion, so that the antenna holder is mounted on the connecting shaft so as to be prevented from rotation. Or the concealed screw is screwed into the concealed screw hole, and the distal end of the concealed screw is spaced from a bottom surface of the ring groove and hooked on a side surface of the ring groove, so that the antenna holder is mounted on the connecting shaft so as to be rotatable and unremovable.

3 Claims, 7 Drawing Sheets

VEHICLE-MOUNTED REPLACEMENT ANTENNA

CROSS-REFERENCE TO RELATED APPLICATIONS

This application is based upon and claims the benefit of priority from the prior Japanese Patent Application No. 2013-143163 filed on Jul. 9, 2013, the entire contents of which are incorporated herein by reference.

BACKGROUND

1. Technical Field

The present disclosure relates to a vehicle-mounted replacement antenna, and more particularly to such a vehicle-mounted replacement antenna which is attachable to an antenna boss to be mounted in replacement of an existent vehicle-mounted antenna.

2. Related Art

There has been conventionally widely used a vehicle-mounted monopole antenna detachably screwed into an antenna boss provided on a vehicle roof. The vehicle-mounted monopole antenna includes a slender cylindrical antenna holder incorporating a helical antenna element. The antenna holder has a proximal end provided with a screw shaft portion which is screwed into a screw hole of an antenna boss. For example, Japanese patent application publication Nos. JP-A-2012-169892 and JP-A-2011-228767 disclose conventional vehicle-mounted monopole antennas.

The vehicle-mounted monopole antenna is detachably screwed into a screw hole of an antenna boss as described above. Accordingly, when a vehicle is washed by a vehicle washer or the vehicle is parked in a garage having a low ceiling, there is a possibility that the antenna may be broken. However, the antenna can be easily detached from the antenna boss.

On the other hand, since the antenna can be easily detached from she antenna boss, she antenna has a high possibility of being thieved when a driver leaves his/her vehicle.

SUMMARY

Therefore, an object of the disclosure is to provide a vehicle-mounted replacement antenna which can he mounted to a vehicle in replacement of the vehicle-mounted antenna and which is difficult to thieve even when the replacement antenna is kept mounted.

The present disclosure provides vehicle-mounted replacement antenna which is mounted on an antenna boss to which a vehicle-mounted antenna is detachably screwed. The vehicle-mounted replacement antenna includes an antenna holder including a cylindrical portion having a proximal end surface formed into an opening, a connecting shaft including a fitting shaft portion rotatably fitted into the cylindrical portion and having two ends, a hook shaft portion provided on one end of the fitting shaft portion and having an outer periphery formed with a ring groove, and a screw shaft portion provided on the other end of the fitting shaft portion and screwable into an existent antenna screw hole of the antenna boss, an antenna element inserted into the cylindrical portion from the opening of the cylindrical portion, and a concealed screw. In the replacement antenna, the cylindrical portion has a screw hole for the concealed screw, extending from an outer surface of the proximal end thereof into a hollow interior thereof. The screw shaft portion is screwed into the existent antenna screw hole so that the connecting shaft is fixed to the antenna boss. The cylindrical portion is caused to cover the connecting shaft from the opening of the proximal end surface thereof. The fitting shaft portion is fitted into the cylindrical portion. The cylindrical portion is fitted with an outer periphery of the existent antenna screw hole, and a distal end of the hook potion is electrically connected to the antenna element. The concealed screw is embedded into the concealed screw hole and a distal end of the concealed screw is pressed against a bottom surface of the ring groove, so that the antenna holder is mounted on the connecting shaft so as to be prevented from rotation, or the concealed screw is screwed into the concealed screw hole, and the distal end of the concealed screw is spaced from the bottom surface of the ring groove and hooked on a side surface of the ring groove, so that the antenna holder is mounted on the connecting shaft so as to be rotatable and unremovable.

According to the above-described construction, the concealed screw is embedded into the concealed screw hole, and the distal end of the concealed screw is pressed against the bottom surface of the ring groove, so that the antenna holder is unrotatably mounted on the connecting shaft. Accordingly, the antenna holder can be fixed to the antenna boss in a predetermined position.

On the other hand, the concealed screw is embedded into the concealed screw hole and the distal end of the concealed screw is slightly spaced from the bottom surface of the ring groove and is further hooked on a side surface of the ring groove 13*e*, whereby the antenna holder is mounted to the connecting shaft so as to be rotatable and unremovable.

Accordingly, unless the concealed screw is found, someone else can rotate the antenna holder with the intention of detaching the antenna holder from the antenna boss, but the connecting shaft is not rotated. Accordingly, the connecting shaft is not detached from the antenna boss. As a result, since the connecting shaft cannot be detached from antenna boss, the vehicle-mounted replacement antenna can be prevented from being thieved.

In one embodiment, a plurality of the ring grooves is formed along an axis of the connecting shaft. According to this, when the cylindrical portion of the antenna holder is fitted with the outer periphery of the existent antenna screw hole, the concealed screw can be inserted into either one of the ring grooves, even in the case where the gap between the proximal end surface of the cylindrical portion and the distal end surface of the antenna screw hole differs depending upon vehicle types. As a result, the vehicle-mounted replacement antenna is convenient since the antennas of a plurality of vehicle types can be replaced by the vehicle-mounted replacement antenna.

In another embodiment, the antenna holder is generally formed into a shark fin shape and the cylindrical portion is formed along a back of the shark fin shape. According to this, the existent antenna can be replaced by a sporty shark fin antenna having a quite different design from the existent antenna.

DETAILED DESCRIPTION

Figure 1:
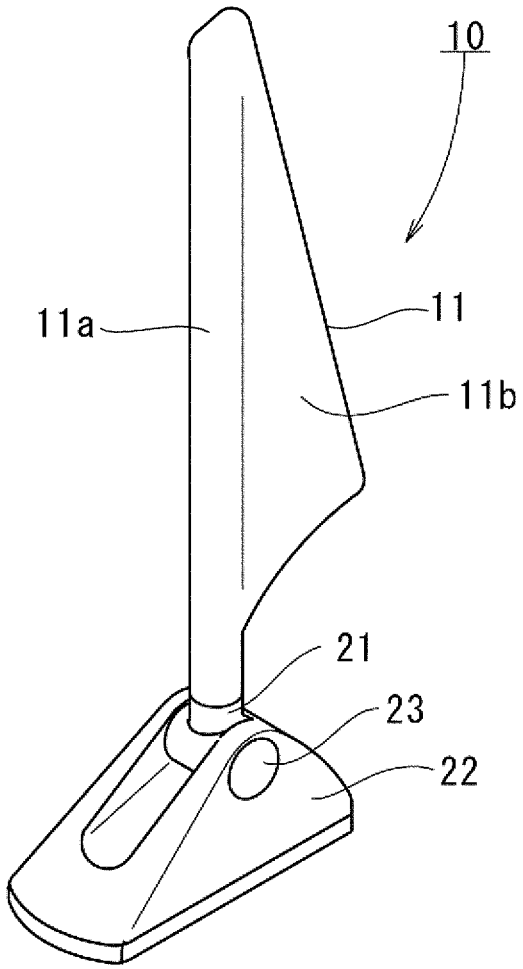
FIG. 1 is a perspective view of a vehicle-mounted replacement cement antenna according to a first embodiment and an antenna boss to which the vehicle-mounted replacement antenna is mounted.
Figure 2:
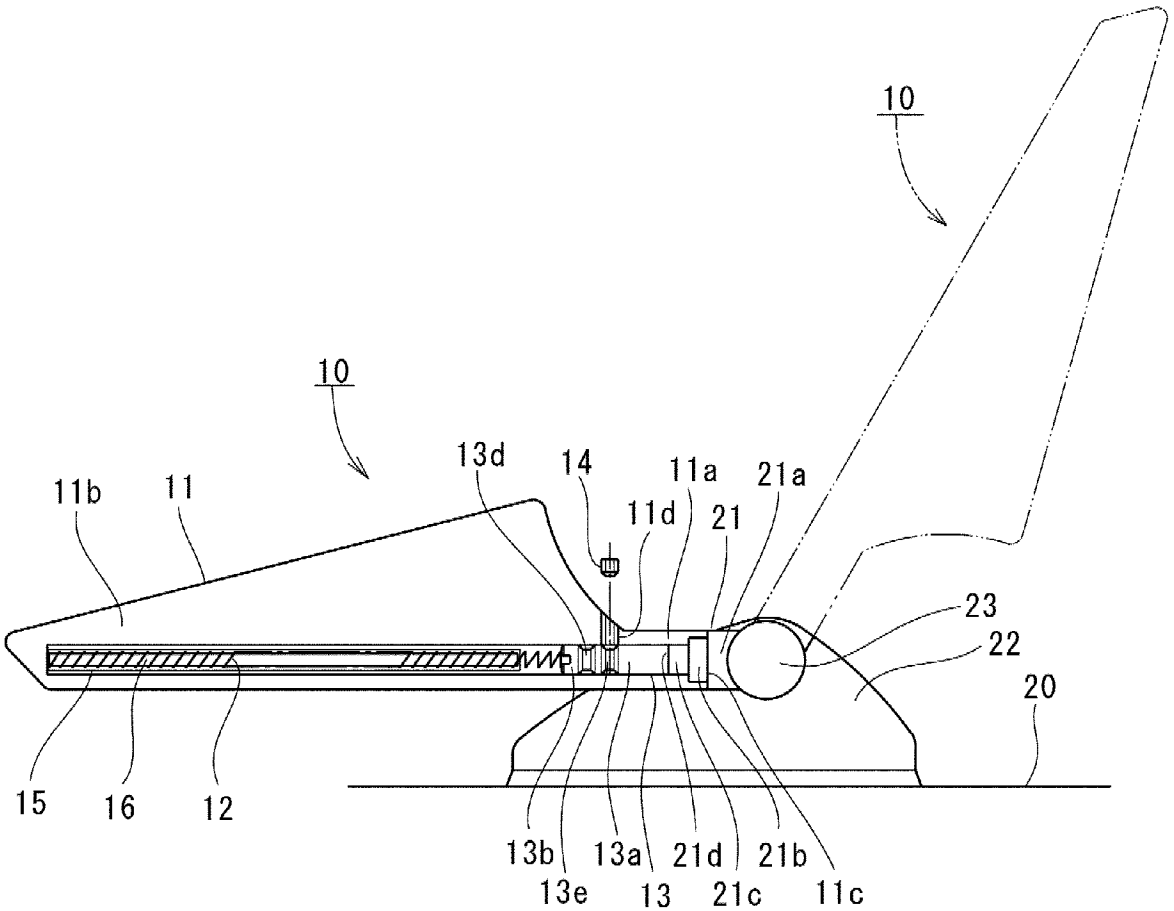
FIG. 2 is a partially broken side view of the vehicle-mounted replacement antenna and the antenna boss to which the vehicle-mounted replacement antenna is mounted.

Embodiments will be described with reference to the accompanying drawings. Referring first to FIGS. 1 and 2, a vehicle-mounted replacement antenna 10 of the first embodiment is shown. The antenna 10 includes an antenna holder 11, a helical antenna element 12, a connecting shaft 13 and a concealed screw 14.

The antenna holder 11 is made of ABS resin and includes a back formed into an elongated cylindrical portion 11*a* and a thin fin portion 11*b* expanding from the back, thereby being formed into the shape of a shark fin. The fin portion 11*b* is formed to be tapered from a proximal end of the cylindrical portion 11*a*. The cylindrical portion 11*a* has a proximal end surface formed into an opening 11*c*. The cylindrical portion 11*a* has a screw hole 11*d* for a concealed screw, extending from an outer surface. of the proximal end to a hollow interior of the cylindrical portion 11*a*.

The helical antenna element 12 formed into a helical shape is covered by a vinyl cover 15. An acrylic rod 16 serving as a dielectric is inserted into the antenna element 12.

Figure 3:
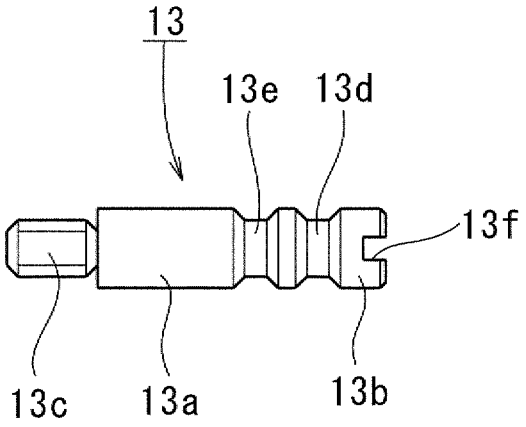
FIG. 3 is a side view of a connecting shaft of the vehicle-mounted replacement antenna.

As shown as an enlarged form in FIG. 3, the connecting shaft 13 includes a fitting shaft portion 13*a*, a hook shaft portion 13*b* provided at one of two ends of the fitting shaft portion 13*a* and a screw shaft portion 13*c* provided at the other end of the fitting shaft portion 13*a*. The fitting shaft portion 13*a* has a diameter set so as to be rotatably fitted into the cylindrical portion 11*a* of the antenna holder 11. The hook shaft portion 13*b* has an outer periphery formed with two ring grooves 13*d* and 13*e*. The screw shaft portion 13*c* is provided with a screw which can be screwed into the existent antenna screw hole of an antenna boss. Further, the hook shaft portion 13*b* has a distal end surface formed with a coin groove 13*f* into which a coin is insertable.

The vehicle-mounted, replacement antenna 10 is thus of the antenna holder 11, the helical antenna element 12, the connecting shaft 13 and the concealed screw 14 as described above. The antenna 10 will be assembled to an antenna boss 21 mounted on a roof 20 of the vehicle in the following procedure. A base 22 is fixed to the roof 2 and includes a top to which a pivot shaft 23 is assembled. The antenna boss 21 is integrally provided on the pivot shaft 23. The antenna boss 21 has a three-stage structure including a large-diameter portion 21*a*, a middle diameter portion 21*b* and a small-diameter portion 21*c*. The uppermost small-diameter portion 21*c* is formed with an existent antenna screw hole 21*d*. An existent antenna (not shown) screwed into the existent antenna screw hole 21*d*. is detached, and a suitable coin is inserted into the coin groove 13*f*, so that the screw shaft portion 13*c* of the connecting shaft 13 is rotated thereby to be screwed into the existent antenna screw hole 21*d*. As a result, the connecting shaft 13 is fixed to the antenna boss 21.

The helical antenna element 12 and the rod 16 both covered by the cover 15 are inserted from the proximal end opening 11*a* of the cylindrical portion 11*a* thereby so be housed in the cylindrical portion 11*a*. Subsequently, the cylindrical portion 11*a* is caused to cover the connecting shaft 13 from the distal end opening 11*c*. The fitting shaft potion 13*a* is then fitted into the cylindrical portion 11*a*, and the proximal end of the cylindrical portion 11*a* is fitted with an outer periphery of the middle diameter portion 21*b* of the existent antenna boss 21. The proximal end of the cylindrical portion 11*a* is caused to abut on an upper end of the large-diameter portion 21*a*. With this, a spring force of the antenna element 12 presses the distal end of the hook shaft portion 13*c* against an end of the helical antenna element 12.

Figure 4:
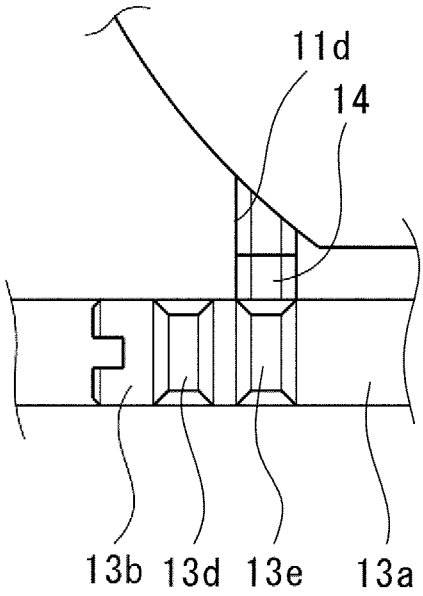
FIG. 4 is a partially enlarged section of a concealed screw hole and a concealed screw of the connecting shaft.

Subsequently, the concealed screw 14 is embedded into the screw hole 11*d* with a tool (not shown), and the distal end of the concealed screw 14 is pressed against the bottom of the ring groove 13*e* at the screw shaft portion 13*c* side, whereby the antenna holder 11 is mounted. to the connecting shaft 13 without being turned, as shown in FIG. 4.

The vehicle-mounted replacement antenna 10 assembled to the antenna boss 21 can be caused to rise from the roof 20 as shown by an imaginary line in FIG. 1 or to fall to the roof 20 as shown by solid line in FIG. 2.

Figure 5:
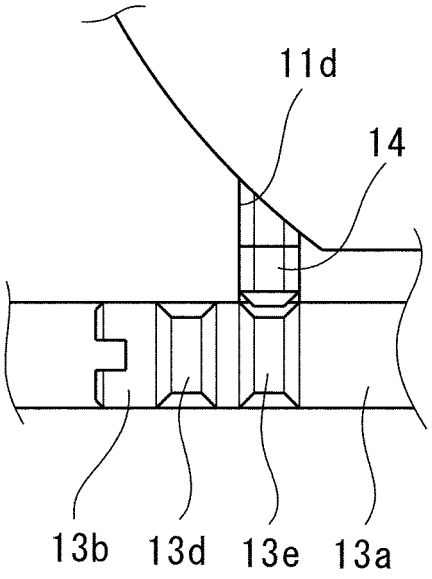
FIG. 5 is also a partially enlarged section of the concealed screw hole and the concealed screw, showing the case where a distal end of the concealed screw is slightly spaced from a ring groove bottom.

When the vehicle is parked for a long time, the concealed screw 14 embedded into the screw hole 11*d*, is turned with a tool in order that the replacement antenna 10 may be prevented from being thieved, as shown in FIG. 5. Consequently, the distal end of the concealed screw 13*e* is slightly spaced from the bottom of the ring groove 13*e* and hooked on a side surface of the ring groove 13*e*, with the result that the antenna holder 11 is mounted on the connecting shaft 13 so as to be pivotable and unremovable.

According to the vehicle-mounted replacement antenna of the first embodiment, the concealed screw 11*d* is embedded into the screw hole lid, and the antenna holder 11 can be unrotatably mounted on the connecting shaft 13. Accordingly, the antenna holder 11 can be fixed to the antenna boss 21 in a predetermined position.

On the other hand, the distal end of the concealed screw 14 is slightly spaced from the hot tom of the ring groove 13*e* and hooked on the side surface of the ring groove 13*e*, whereby the antenna holder 11 can be mounted to the connecting shaft 13 so as to be rotatable and unremovably. Accordingly, unless the concealed screw 14 is found, someone else can rotate the antenna holder 11 with the intention of detaching the antenna holder 11 from the antenna boss 21, but the connecting shaft 13 is not rotated. Accordingly, the connecting shaft 13 is not detached from the antenna boss 21. As a result, since the connecting shaft 13 cannot be detached from antenna boss 21, the vehicle-mounted replacement antenna can be prevented from being thieved.

Further, the existent antenna can be replaced by a sporty shark fin antenna having a quite different design from the existent antenna.

Figure 6:
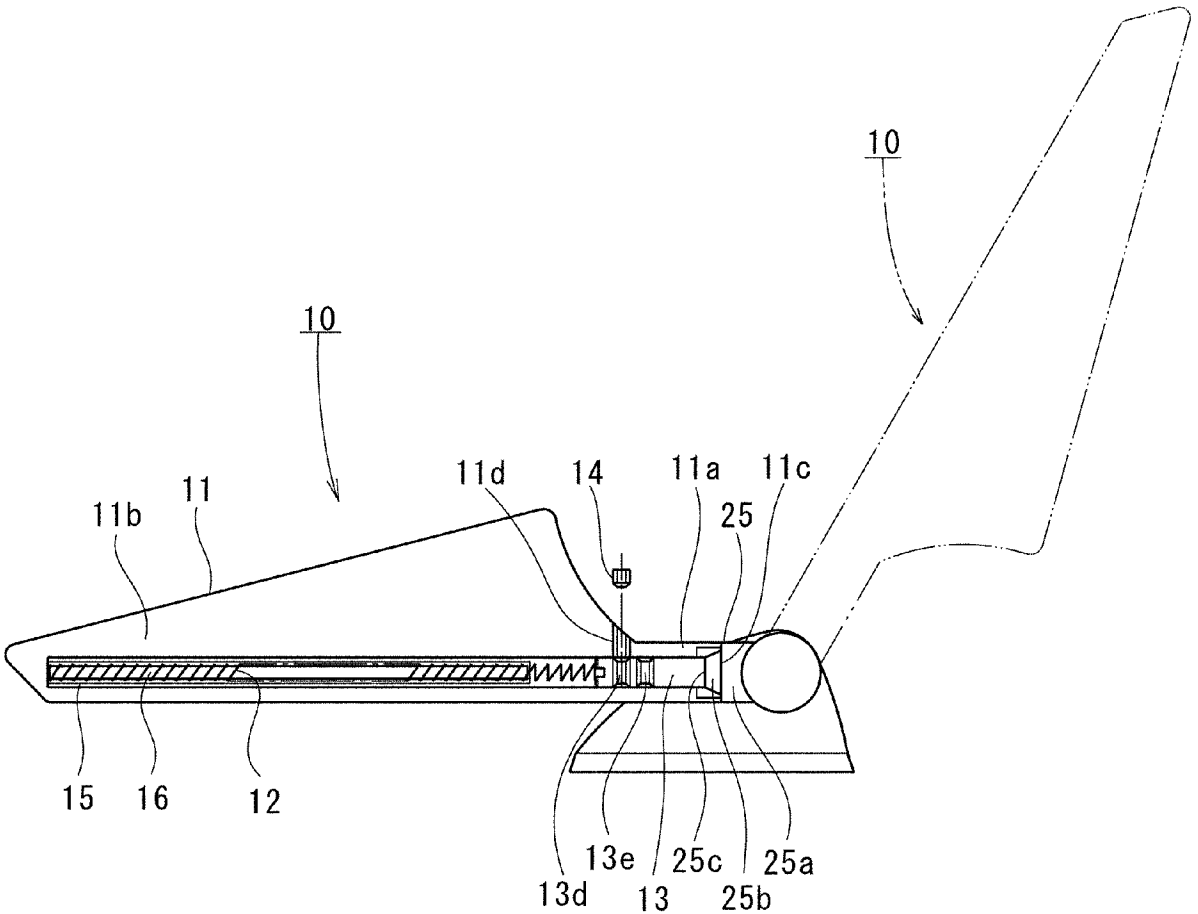
FIG. 6 is a partially broken side view of the vehicle-mounted replacement antenna mounted to another antenna boss.

FIG. 6 shows another case where the vehicle-mounted replacement antenna 10 is mounted to an antenna boss 25 of another type. The foregoing antenna boss 21 has the three-stage structure including the large-diameter portion 21*a*, the middle-diameter portion 21*b* and the small-diameter portion 21*c*. The uppermost small-diameter portion 21*c* is formed with the existent antenna screw hole 21*d*. On the other hand, an antenna boss 25 as shown in FIG. 6 has a two-stage structure including a large-diameter portion 25*a*. and a middle-diameter portion 25*b*. The middle-diameter portion 25*b* is formed with an antenna screw hole 25*c*. in order that the antenna holder 11 may be mounted to the antenna boss 25, the middle-diameter portion 25*b* is fitted into the cylindrical portion ha of the antenna holder 11.

The above-described antenna boss 21 and the antenna boss 25 differ from each other in a gap between the proximal end surface of the cylindrical, portion 11*a* and the distal ends of the existent antenna boss 21*d* or 25*c* in the case where the cylindrical portion 11*a* of the antenna holder 11 is fitted with the outer periphery of the antenna boss 21 or 25. The gap in the antenna boss 25 is shorter than the gap in the antenna boss 21. Accordingly, when the cylindrical portion 11*a* is caused to cover the middle-diameter portion 25*b* of the antenna boss 25, and the end surface of the cylindrical portion 11*a* is caused to abut on the upper end of the large-diameter portion 25*a*, the concealed screw hole lid is opposed to the ring groove 13*d* at the hook shaft portion 13*b* side, so that the concealed screw 14 is embedded into the concealed screw hole 13*d*.

Figure 7:
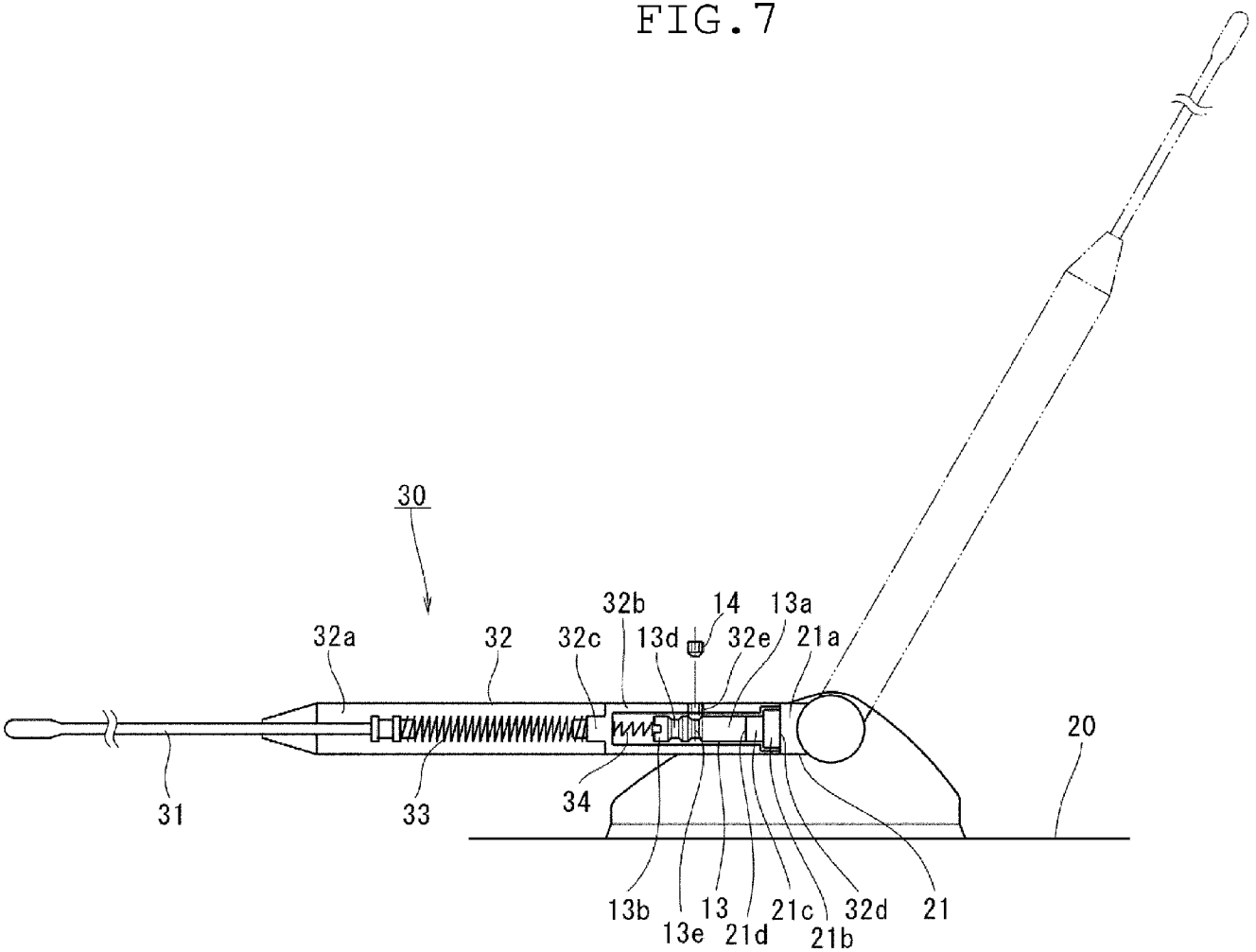
FIG. 7 is a partially broken side view of a vehicle-mounted replacement antenna according to a second embodiment and an antenna boss to which the vehicle-mounted replacement antenna is mounted.

The two rind grooves 13*d* and 13*e* are thus formed along the axis of the connecting shaft 13. Accordingly, when the cylindrical portion ha of the antenna holder 11 is fitted with the outer periphery of the existent antenna screw hole 21*d* or 25*d* of the antenna boss 21 or 25, the concealed screw 14 can be inserted into either the ring groove 13*d* or 13*e* even in the case where the gap between the proximal end surface of the cylindrical portion 11*a* and the distal end surface of the existent antenna screw hole 21*d* or 25*d* differs depending upon vehicle types. As a result, the vehicle-mounted replacement antenna 10 is convenient since the antennas of a plurality of vehicle types can be replaced by the vehicle-mounted replacement antenna FIG. 7 illustrates a vehicle-mounted replacement antenna 30 according to a second embodiment. The vehicle-mounted replacement antenna 30 includes a rod antenna 31 as the antenna element although the vehicle-mounted replacement antenna 10 of the first embodiment includes the helical antenna 12 as the antenna element. The rod antenna 31 is assembled to the antenna holder 32.

The antenna holder 32 includes a flexible portion 32*a* made of rubber-like plastic and a cylindrical portion 32*b* made of an electrically conductive metal. A proximal end of the rod antenna 31 and a bending coil spring 33 are buried in the flexible portion 32*a* by integral molding. The flexible portion 32*a* has a proximal end formed with a fitting recess 32*c* The cylindrical portion 32*b* has a distal end which is fitted into the fitting recess 32*c*. The cylindrical portion 32*b* has a proximal end formed into an opening 32*d*. A contact spring 34 is accommodated in the interior of the cylindrical portion 32*b*. Further, the cylindrical portion 32*b* is formed with a screw hole 32*e* for a concealed screw. The cylindrical portion 32*b* has a distal end fitted into the fitting recess 32*c* of the flexible portion 32*a*. The flexible portion 32*a* and the cylindrical portion 32*b* are integrally joined together by welding.

In the second embodiment, the cylindrical portion 32*b* is caused to cover the connecting shaft 13 screwed into the existent antenna screw hole 21*d* of the antenna boss 21, from the opening 32*d*. The concealed screw 14 is then screwed into the screw hole 32*e*, and the distal end of the concealed screw 14 is pressed against the ring groove 13*e*, whereby the antenna holder 32 of the vehicle-mounted replacement antenna 30 is fixed to the antenna boss 21.

On the other hand, the distal end of the concealed screw 14 is slightly spaced from the bottom surface of the ring groove 13*e* and is further hooked on a side surface of the ring groove 13*e*, whereby the antenna holder 32 is mounted to the connecting shaft 13 so as to be rotatable and unremovable. Consequently, the vehicle-mounted replacement antenna can be prevented from being thieved.

Further, the bending spring 33 is interposed between the rod antenna 31 and the cylindrical portion 32*b*. Accordingly, when an external force is applied to the rod antenna 31, the flexible portion 32*a* is flexed thereby to prevent the rod antenna 31 from being broken.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A vehicle-mounted replacement antenna which is mounted on an antenna boss to which an existent vehicle-mounted antenna is detachably screwed, the vehicle-mounted replacement antenna comprising:

an antenna holder including a cylindrical portion having a proximal end surface formed into an opening;

connecting shaft including a fitting shaft portion rotatably fitted into the cylindrical portion and having two ends, a hook shaft portion provided on one end of the fitting shaft portion and having an outer periphery formed with a ring groove, and a screw shaft portion provided on the other end of the fitting shaft portion and screwable into an existent antenna screw hole of the antenna boss;

an antenna element inserted into the cylindrical portion from the opening of the cylindrical portion; and a concealed screw, wherein:

the cylindrical portion has a screw hole for the concealed screw, extending from an outer surface of the proximal end thereof into a hollow interior thereof;

the screw shaft portion is screwed into the existent antenna screw hole so that the connecting shaft is fixed to the antenna boss;

the cylindrical portion is caused to cover the connecting shaft from the opening of the proximal end surface thereof, the fitting shaft portion is fitted into the cylindrical portion, the cylindrical portion is fitted with an outer periphery of the existent antenna screw hole, and a distal end of the hook potion is electrically connected to the antenna element; and the concealed screw is embedded into the concealed screw hole and a distal end of the concealed screw is pressed against a bottom surface of the ring groove, so that the antenna holder is mounted on the connecting shaft so as to be prevented from rotation, or the concealed screw is screwed into the concealed screw hole, and the distal end of the concealed screw is spaced from the bottom surface of the ring groove and hooked on a side surface of the ring groove, so that the antenna holder is mounted on the connecting shaft so as to be rotatable and unremovable.

2. The vehicle-mounted replacement antenna according claim 1, wherein a plurality of the ring grooves is formed along an axis of the connecting shaft.

3. The vehicle-mounted replacement antenna according claim 1, wherein the antenna holder is generally formed into a shark fin shape and the cylindrical portion is formed along a back of the shark fin shape.

* * * * *